US006443223B2

(12) United States Patent
Ichiyanagi

(10) Patent No.: US 6,443,223 B2
(45) Date of Patent: Sep. 3, 2002

(54) CONNECTING DEVICE FOR HEAT EXCHANGER

(75) Inventor: Shigeharu Ichiyanagi, Utsunomiya (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/805,557

(22) Filed: Mar. 14, 2001

Related U.S. Application Data

(62) Division of application No. 09/301,329, filed on Apr. 29, 1999.

(30) Foreign Application Priority Data

Apr. 30, 1998 (JP) ..... 10-120496

(51) Int. Cl.[7] ..... F28F 9/04
(52) U.S. Cl. ..... 165/178; 165/153
(58) Field of Search ..... 165/153, 176, 165/178; 62/299; 285/137.11, 136.1, 141.1

(56) References Cited

U.S. PATENT DOCUMENTS 5,163,716 A 11/1992 Bolton et al.
5,477,919 A 12/1995 Karube
5,630,326 A * 5/1997 Nishishita et al. ..... 62/299
5,711,370 A 1/1998 Tanaka
5,911,127 A 6/1999 Inaba et al.

FOREIGN PATENT DOCUMENTS

EP 0693667 A1 1/1996
EP 07032425 A1 3/1996
GB 2290862 1/1996

OTHER PUBLICATIONS

European Search Report dated Mar. 13, 2000.

* cited by examiner

*Primary Examiner*—Allen Flanigan
(74) *Attorney, Agent, or Firm*—Armstrong, Westerman & Hattori, LLP

(57) ABSTRACT

A connecting device for a heat exchanger which has a fluid circulating channel formed with an opening at one end thereof and an opening at the other end thereof, the openings being formed as juxtaposed in one side of the heat exchanger. The connecting device comprises a blocklike connector body having two horizontal through bores corresponding to the respective openings and fixed to the heat exchanger with the through bores in coincidence with the respective openings. A tubular member is fluid-tightly fitted in each of the through bores and has a connecting end projecting toward a connectable device. The connecting end is in the form of a spigot fittable in a socket of the connectable device.

5 Claims, 6 Drawing Sheets

CONNECTING DEVICE FOR HEAT EXCHANGER

This application is a division of prior application Ser. No. 09/301,329 filed Apr. 29, 1999.

BACKGROUND OF THE INVENTION

The present invention relates to connecting devices for heat exchangers such as evaporators and condensers.

The term "aluminum" as used herein and in the claims includes pure aluminum and aluminum alloys.

For use with heat exchangers having a fluid circulating channel and two openings of respective opposite ends of the channel formed as juxtaposed in one side of the heat exchanger, a connecting device is known which comprises a connector having two horizontal through bores corresponding to the respective openings and fixed to the heat exchanger with the through bores in coincidence with the respective openings. The connector comprises a blocklike body adjacent to the heat exchanger, and two short tubular projections provided on the connector body around edges thereof defining the respective through bores and to be opposed to a connectable device, each of the tubular projections being in the form of a spigot fittable in a socket of the connectable device. Since the connector has the structure described above, the two spigot portions must be made from a large block of material by cutting. This not only causes waste of a large quantity of the material but also gives rise to the problem that after one of the spigot portions has been formed by cutting, this spigot portion interferes with the cutting operation for making the other spigot portion.

An object of the present invention is to provide a connecting device for heat exchangers which is easy to make without involving waste of material.

SUMMARY OF THE INVENTION

To fulfill the above object, the present invention provides a connecting device for a heat exchanger having a fluid circulating channel formed with an opening at one end thereof and an opening at the other end thereof, the openings being formed as juxtaposed in one side of the heat exchanger, the connecting device comprising a blocklike connector body having two horizontal through bores corresponding to the respective openings and fixed to the heat exchanger with the through bores in coincidence with the respective openings, a tubular member being fluid-tightly fitted in each of the through bores and having a connecting end projecting toward a connectable device, the connecting end being in the form of a spigot fittable in a socket of the connectable device. The spigots thus provided need not be formed from a blank of material by cutting.

The present invention will be described below in greater detail with reference to the accompanying drawings.

DESCRIPTION OF THE PREFERRED EMBODIMENTS

Figure 9:
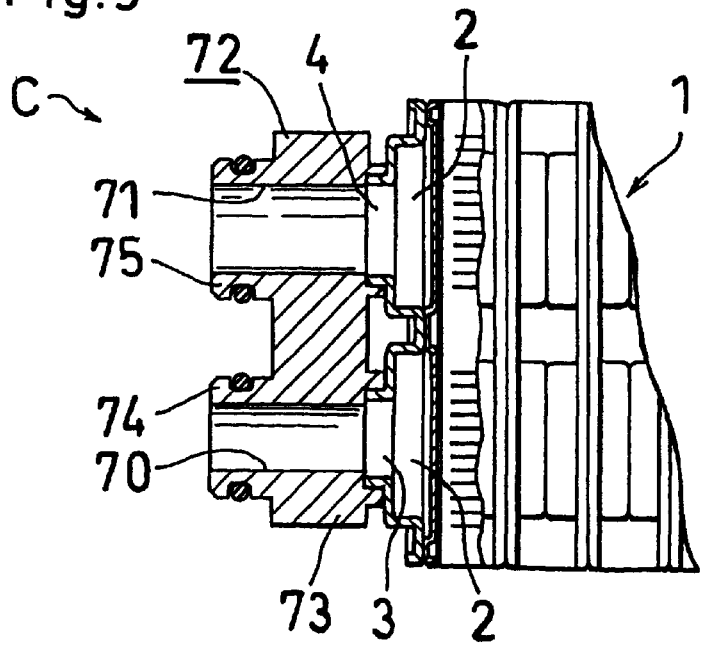
PRIOR ART Fig.9
FIG. 9 is a view in section partly broken away, corresponding to FIG. 2 and showing a conventional connecting device.

For a better understanding of the present invention, a conventional connecting device C for a heat exchanger 1 will be described with reference to FIG. 9 before the description of the invention. The heat exchanger 1 has a fluid circulating channel formed with an opening 3 at one end thereof and an opening 4 at the other end thereof, the openings 3, 4 being formed as juxtaposed in one side of the heat exchanger 1. The illustrated connecting device C comprises a connector 72 having two horizontal through bores 70, 71 corresponding to the respective end openings 3, 4 and fixed to the heat exchanger 1 with the through bores 70, 71 in coincidence with the respective openings 3, 4. The connector 72 comprises a blocklike connector body 73 adjacent to the heat exchanger 1, and two short tubular projections provided on the connector body 73 around edges thereof defining the respective through bores 70, 71 and to be opposed to a connectable device, the tubular projections being in the form of spigots 74, 75 fittable in respective sockets of the connectable device. Since the two spigot portions 74, 75 must be formed by cutting a large block of material, the connector 72 has the foregoing problem.

The heat exchangers and connecting devices to be described below with reference to the following embodiments are all made from aluminum.

Embodiment 1

Figure 1:
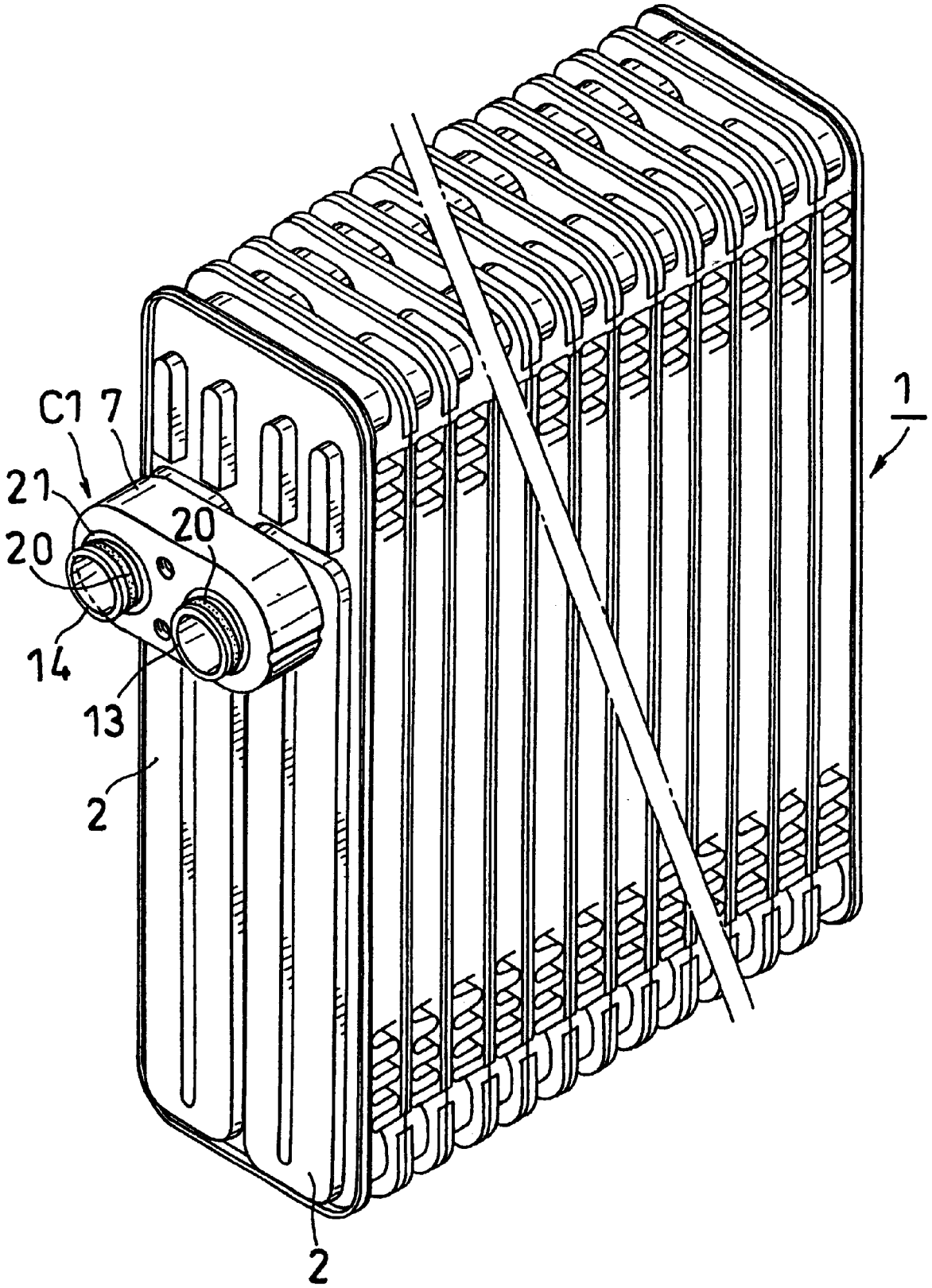
FIG. 1 is a perspective view showing a multilayer evaporator as a heat exchanger provided with a connecting device of the invention, i.e., Embodiment 1.
Figure 2:
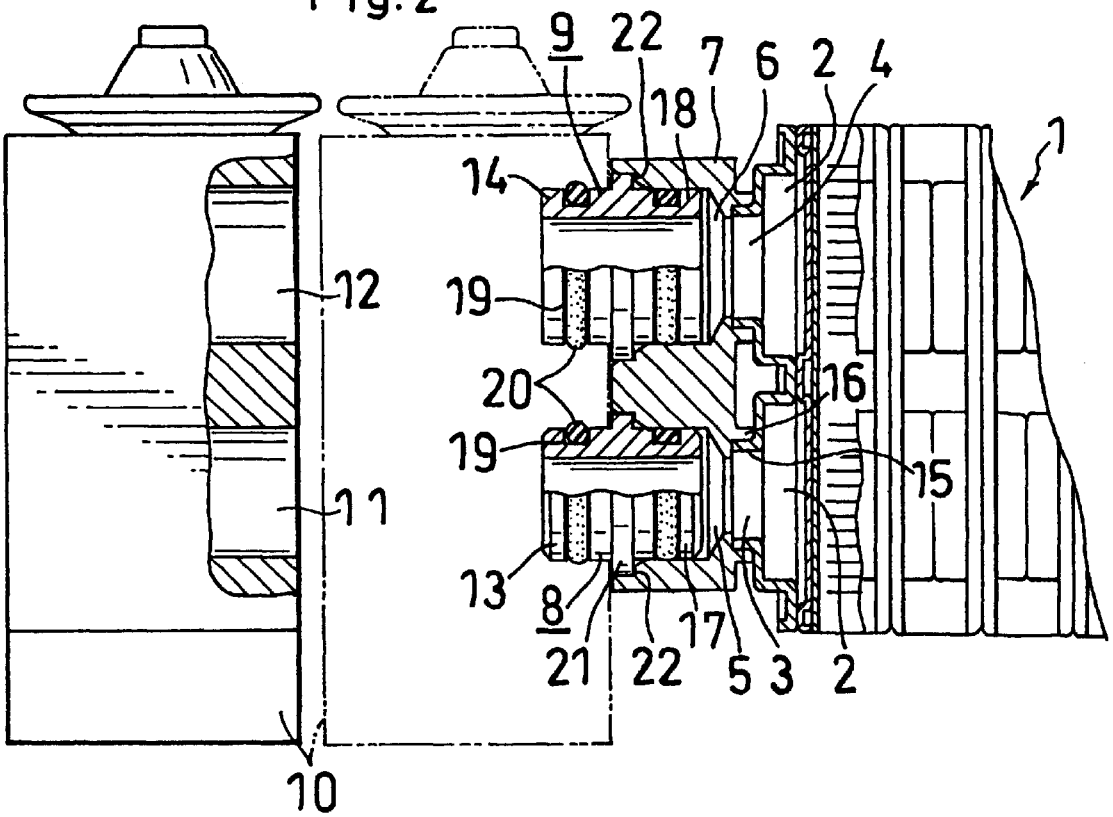
FIG. 2 is a plan view partly broken away and showing the connecting device of FIG. 1 and an expansion valve of the block type as a connectable device before the valve is connected to the heat exchanger.

FIGS. 1 and 2 show this embodiment, i.e., a connecting device C1, for use with a heat exchanger 1 shown which has a fluid circulating channel 2 formed with an opening 3 at one end thereof and an opening 4 at the other end thereof, the openings 3, 4 being formed as juxtaposed in one side wall of the heat exchanger 1. The connecting device C1 comprises a blocklike connector body 7 having two horizontal through bores 5, 6 corresponding to the respective openings 3, 4 and fixed to the heat exchanger 1 with the through bores 5, 6 in coincidence with the respective openings 3, 4. Tubular members 8, 9 are fluid-tightly fitted in the respective through bores 5, 6, with connecting ends thereof projecting toward a connectable device 10 (i.e., device to be connected to the exchanger 1). The connecting ends of the tubular members 8, 9 are in the form of spigots 13, 14 fittable in respective sockets 11, 12 of the connectable device 10.

The side wall of the heat exchanger 1 has an edge defining each of the openings 3, 4 and formed with an annular projection 15, and the connector body 7 has an edge defining each of the through bores 5, 6 and formed with an annular projection 16. The former annular projection 15 is fitted in and brazed to the latter annular projection 16 in lapping relation to thereby fix the connector body 7 to the heat exchanger 1. The connector body 7 is in the form of a horizontally elongated circle when seen from one side, and in the form of a horizontally elongated rectangle except the two annular projections 16 when seen from above. The connector body 7 is obtained by cutting an aluminum extrudate to a predetermined size and further cutting the resulting block as specified.

The spigot 13 (14) of each tubular member 8 (9) and the portion 17 (18) thereof fitted in the through bore 5 (6) are each formed with an annular groove 19, and an O-ring is fitted in the annular groove 19. The fluid-tight fit of the tubular member 8 (9) in the through bore 5 (6) is realized by the O-ring 20. An annular positioning flange 21 is formed on the outer periphery of the tubular member 8 (9) approximately at the lengthwise midportion thereof, and the inner peripheral surface of the connector body 7 defining the through bore 5 (6) is formed with an annular stepped portion 22 for receiving the positioning flange 21. The through bore 5 (6) is tapered toward the bore end from the portion thereof where the extremity of the fitted portion 17 (18) of the tubular member 8 (9) therein is positioned, and the inner periphery of the connector body 7 defining the bore end is formed with an annular stepped portion for receiving the annular projection 15 round the opening 3 (4) of the fluid circulating channel 2.

Embodiment 2

Figure 3:
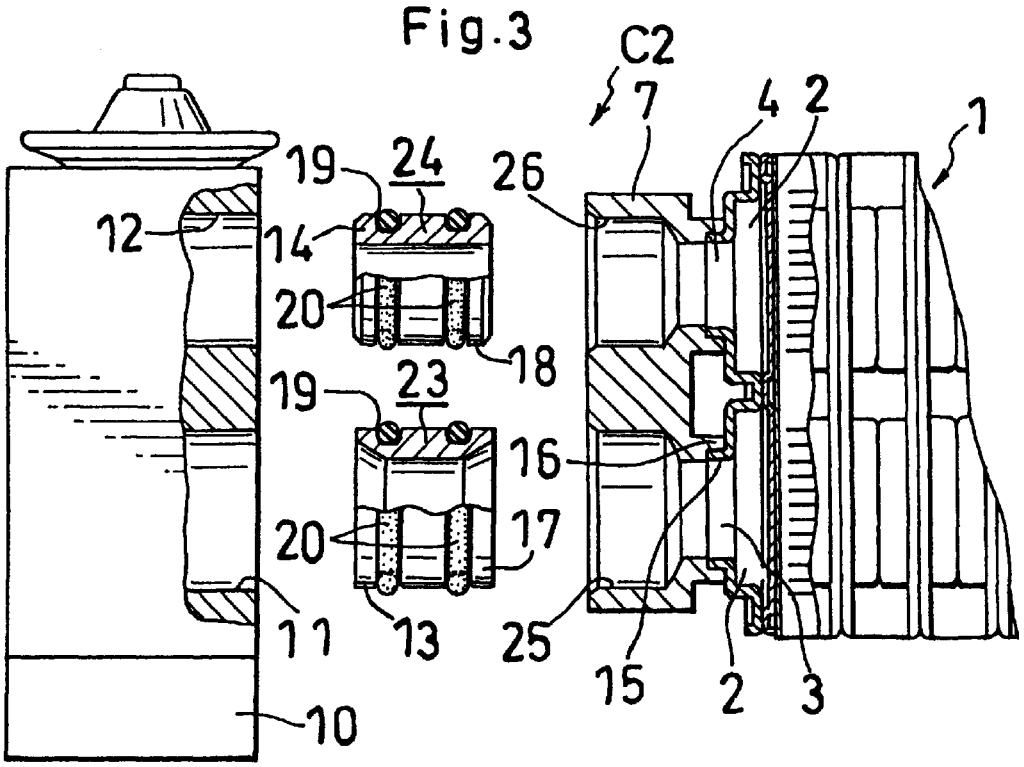
FIG. 3 is a plan view partly broken away and showing another connecting device of the invention, i.e., Embodiment 2, in an exploded state along with a connectable device in the same state as in FIG. 2.

FIG. 3 shows this embodiment, i.e., a connecting device C2, for use with a heat exchanger 1. Unlike Embodiment 1, this embodiment has no annular positioning flange on the outer periphery of each of tubular portions 23, 24 approximately at the midportion thereof, and the inner periphery defining each of through bores 25, 26 correspondingly has no positioning flange bearing. stepped portion. With the exception of this feature, Embodiment 2 is substantially the same as Embodiment 1.

Embodiment 3

Figure 4:
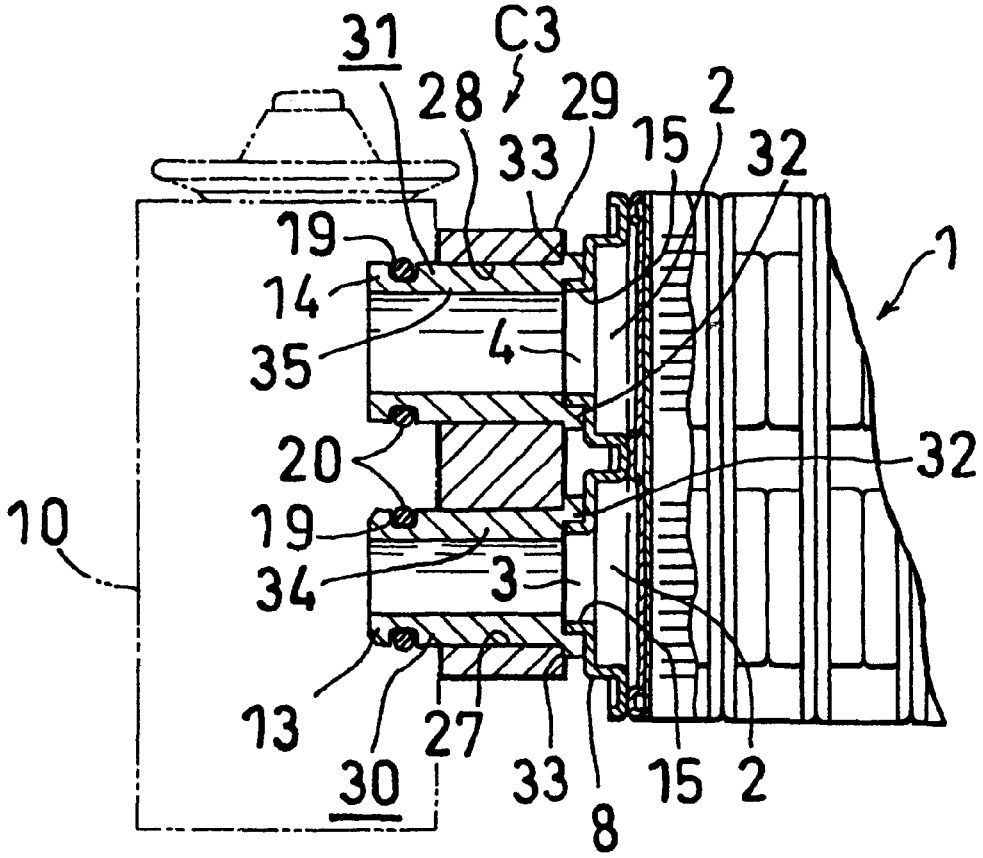
FIG. 4 is a plan view partly broken away and showing another connecting device of the invention, i.e., Embodiment 3.
Figure 5:
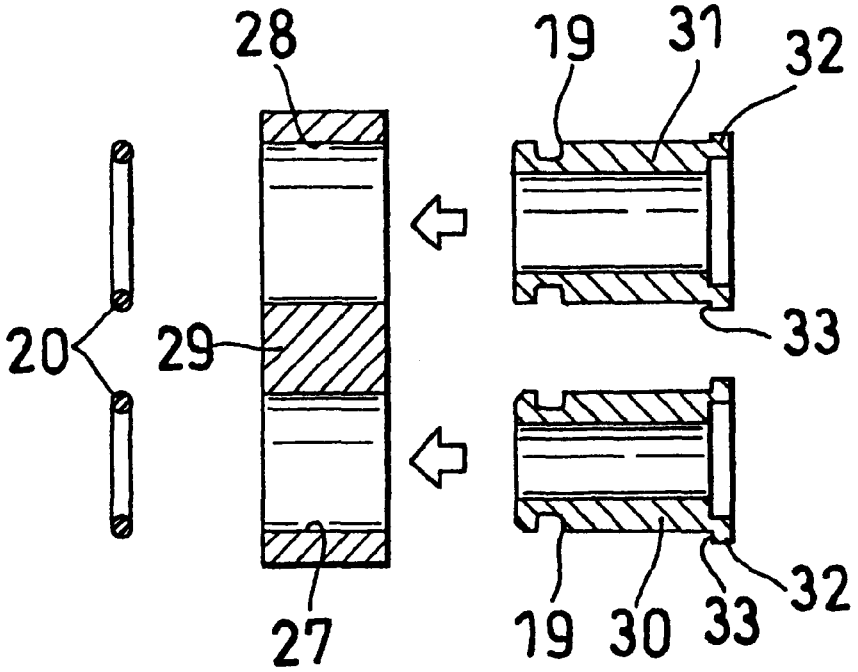
FIG. 5 is an exploded view in horizontal section of the connecting device of FIG. 4 to show the order of assembly.

FIGS. 4 and 5 show this embodiment, i.e., a connecting device C3, for use with a heat exchanger 1 shown which has a fluid circulating channel 2 formed with an opening 3 at one end thereof and an opening 4 at the other end thereof, the openings 3, 4 being formed as juxtaposed in one side wall of the heat exchanger 1. The connecting device C3 comprises a blocklike connector body 29 having two horizontal through bores 27, 28 corresponding to the respective openings 3, 4 and provided for the heat exchanger 1 with the through bores 27, 28 in coincidence with the respective openings 3, 4. Tubular members 30, 31 are fluid-tightly fitted in the respective through bores 27, 28, with connecting ends thereof projecting toward a connectable device 10 (i.e., device to be connected to the exchanger 1). The connecting ends of the tubular members 30, 31 are in the form of spigots 13, 14 fittable in respective sockets of the connectable device 10. The tubular members 30, 31 are fixed to the heat exchanger 1.

The side wall of the heat exchanger 1 has an edge defining each of the openings 3, 4 and formed with an annular projection 15, and the connector body 29 has an edge defining each of the through bores 5, 6 and provided with an annular projection 32. The former annular projection 15 is fitted in and brazed to the latter annular projection 32 in lapping relation to thereby fix each tubular member 30 (31) to the heat exchanger 1.

The annular projection 32 has a larger outer periphery than the tubular member 30 (31), whereby a connector body receiving stepped portion 32 is formed. The annular projection 32 has a larger inner periphery than the tubular member 30 (31), whereby an annular stepped portion is formed in the inner periphery of the edge of the bored portion for receiving the annular projection 15 around the opening 3 (4) of the channel 2. Each of the tubular members 30, 31 has an annular groove 19 formed in its spigot 13 (14) and an O-ring 20 fitted in the annular groove 19. The fluid-tight fit of the tubular member 30 (31) in the through bore 27 (28) is realized by enlarging the portion 34 (35) of the tubular member 30 (31) fitted in the through bore 27 (28). The portion 34 (35) is enlarged using a usual jig useful for enlarging pipes or tubes. The connecting device C3 is assembled in the order shown in FIG. 5 by inserting the tubular members 30, 31 through the respective bores 27, 28 of the blocklike connector body 29 as indicated by arrows in the drawing to engage the stepped portions 33 with the edges of the respective bored portions of the connector body 29. When the tubular members 30, 31 are fixed to the heat exchanger 1 by brazing, the connector body 29 is consequently received by the stepped portions 33. The O-rings 20 are fitted into the respective annular grooves 19 after the tubular members 30, 31 have been fixed to the heat exchanger 1.

The blocklike connector body 29 of the present embodiment is identical with the connector body 7 of Embodiment 1 in shape when seen from one side, and is perfectly in the form of a horizontally elongated rectangle when seen from above. Accordingly, the body 29 has no portion which needs to be made by cutting.

Throughout Embodiments 1 to 3, the heat exchanger 1 is a multilayer evaporator, while the connectable device 10 is an expansion valve of the block type. The spigot 13 provides an inlet for a fluid, and the other spigot 14 provides an outlet for the fluid. In connection with Embodiments 1 to 3, like parts are designated by like reference numerals and are not described repeatedly.

Embodiment 4

Figure 6:
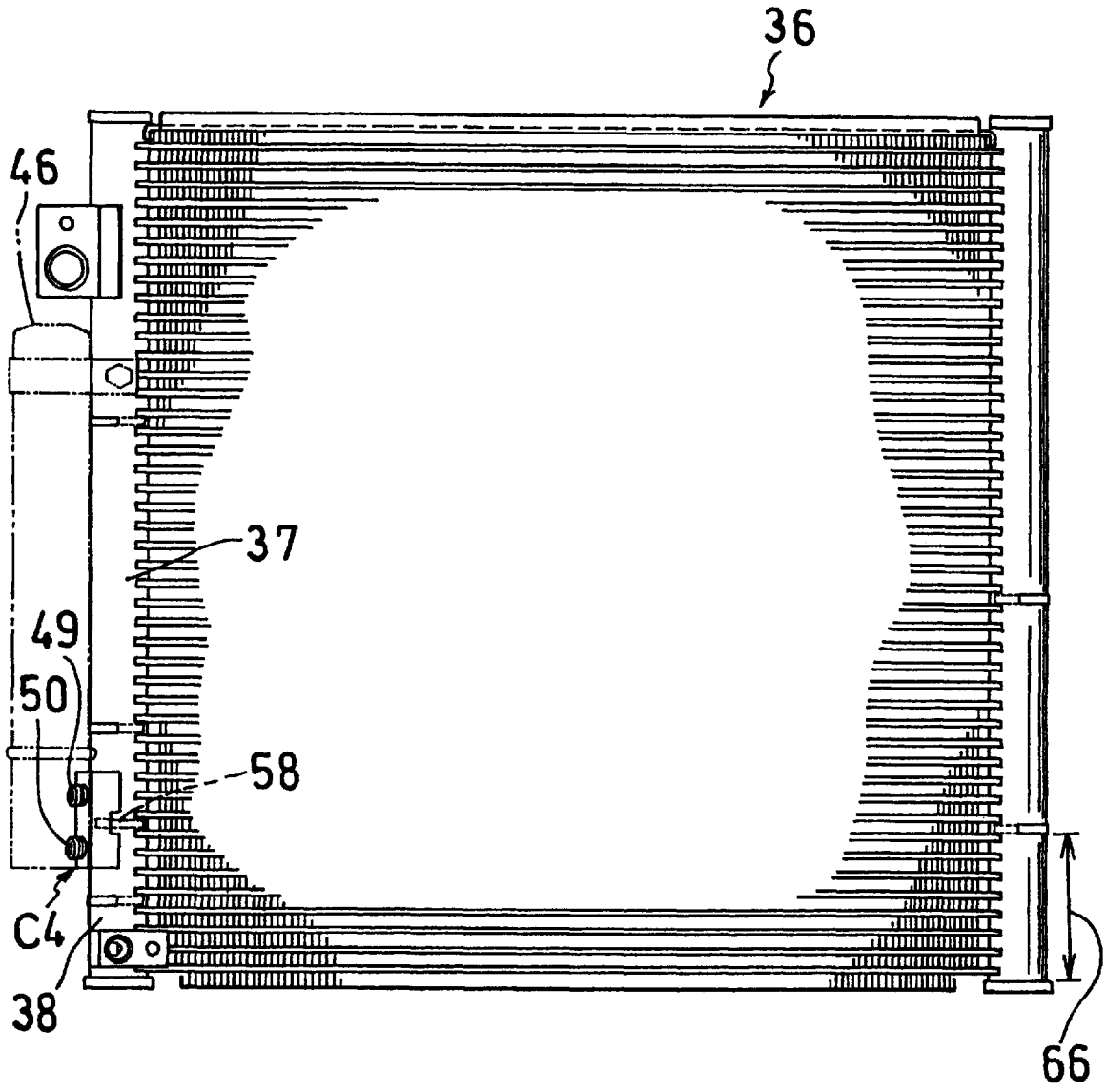
FIG. 6 is a front view of a condenser provided with a supercooling unit and serving as a heat exchanger which has another connecting device of the invention, i.e., Embodiment 4.
Figure 7:
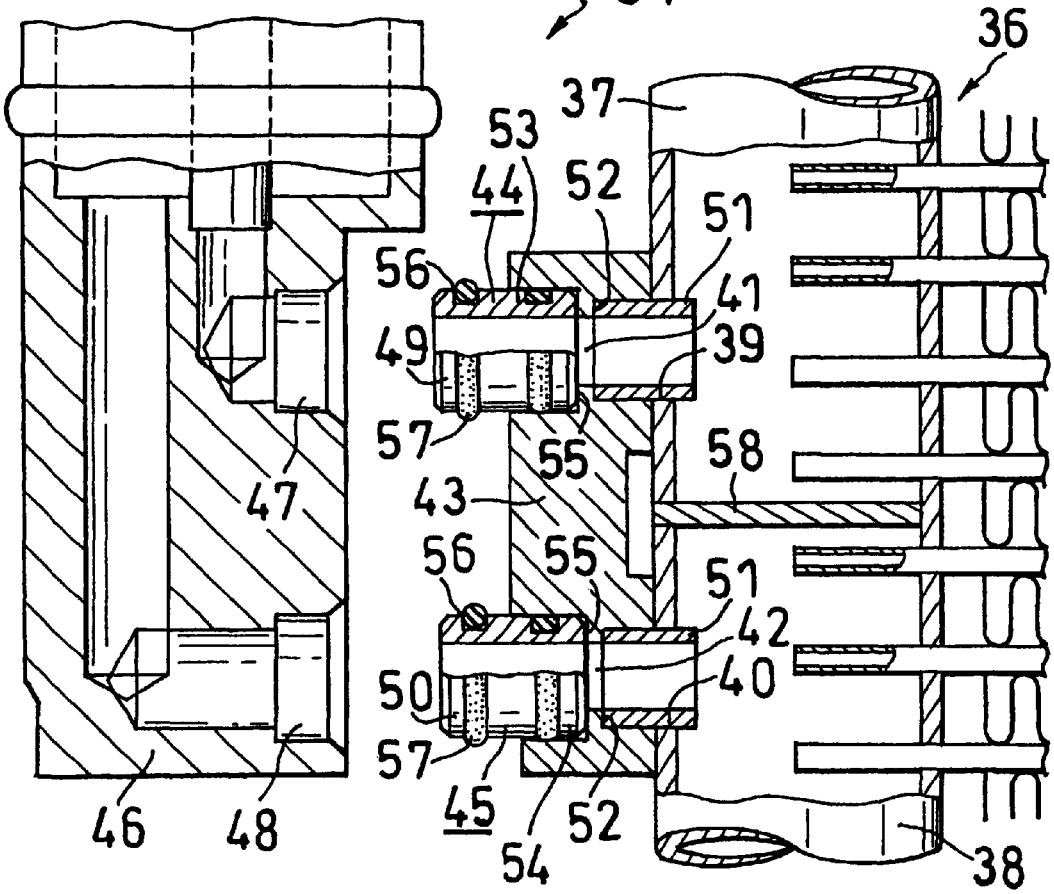
FIG. 7 is a front view partly broken away and showing the connecting device of FIG. 6 and a liquid receiver as a connectable device before the receiver is connected to the heat exchanger.

FIGS. 6 and 7 show this embodiment, i.e., a connecting device C4, for use with a heat exchanger 36 shown which has as arranged at one side thereof a vertical upper header 37 and a vertical lower header 38 integral therewith. The upper header 37 and the lower header 38 have a lower-end opening 39 and an upper-end opening 40, respectively, as arranged in a vertical row. The connecting device C4 comprises a blocklike connector body 43 in the form of a vertically elongated rectangle in vertical section, having two through bores 41, 42 corresponding to the respective openings 39,40 and fixed to the heat exchanger 36 with the through bores 41,42 in coincidence with the respective openings 39, 40. Tubular members 44, 45 are fluid-tightly fitted in the respective through bores 41, 42 and each have a connecting end projecting toward a connectable device 46. The connecting ends are in the form of spigot 49, 50 fittable in respective sockets 47, 48 of the connectable device 46. A member 51 in the form of a short tube for positioning the connector body 43 is fixedly fitted in each of the openings 39, 40 so as to project into the header by a short length and into the connector body 43 by a long length. The connector body 43 has an inner peripheral surface defining each of the through bores 41, 42 and formed with an annular stepped portion 52 for receiving the positioning member 51, the bore-defining peripheral surface being formed, at one side thereof opposite to the positioning member 51, with an annular stepped portion 55 for receiving the portion 53 (54) of the tubular member 44 (45) fitted in. The spigot 49 (50) of the tubular member 44 (45) and the portion 53 (54) thereof fitted in the through bore 41 (42) are each formed with an annular groove 56, and an O-ring 57 is fitted in the annular groove 56. The fluid-tight fit of the tubular member 44 (45) in the through bore 41 (42) is realized by the O-ring 57. The upper header 37 is separated from the lower header 38 by a partition 58.

Embodiment 5

Figure 8:
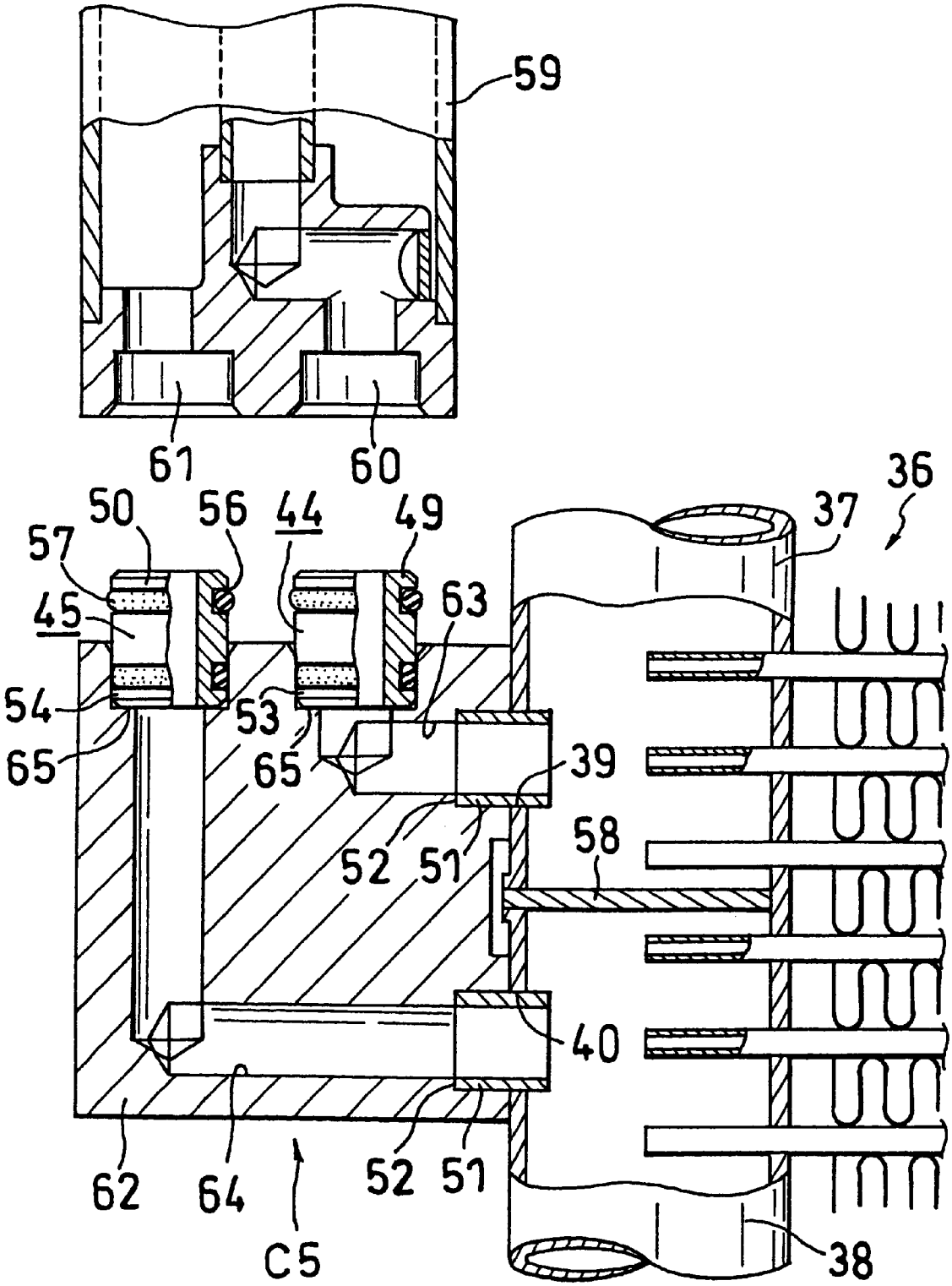
FIG. 8 is a front view partly broken away and showing another connecting device of the invention, i.e., Embodiment 5, and a liquid receiver different from that of FIG. 7 and serving as a connectable device before the receiver is connected to the heat exchanger.

FIG. 8 shows this embodiment, i.e., a connecting device C5. In the case of Embodiment 4, the connectable device 46 has the sockets 47, 48 in the outer periphery of its lower portion, whereas with this embodiment, sockets 60, 61 are formed in the bottom of a connectable device 59. Accordingly, the device C5 comprises a connector body 62 which is approximately square in vertical section and formed with L-shaped through bores 63, 64. The upper end of the connector body 62 has an inner peripheral surface defining each of each through bore 63 (64) and formed with an annular stepped portion 65, which faces upward for receiving the portion 53 (54) of each tubular member 44 (45) fitted in the connector body 62. With the exception of this feature, Embodiment 5 is substantially the same as Embodiment 4. In connection with Embodiments 4 and 5, like parts are designated by like reference numerals and will not be described repeatedly.

In the case of Embodiments 4 and 5, the heat exchanger 36 is a condenser having a supercooling unit which is provided by the portion of the heat exchanger below a horizontal plane through the boundary between the upper header 37 and the lower header 38, while each of the connectable devices 46, 59 is a liquid receiver. The spigot 49 provides an outlet for a fluid, i.e., the refrigerant subjected to condensation by the condenser, and the other spigot 50 provides an inlet of the supercooling unit 66 for the fluid, i.e., the refrigerant as passed through the receiver, that is, as purified.

The tubular members 8, 9, 23, 24, 30, 31, 44, 45 of Embodiments 1 to 5 are each obtained by cutting a hollow aluminum extrudate to a predetermined size and further cutting the resulting piece as specified.

What is claimed is:

1. A connecting device for a heat exchanger having as arranged at one side thereof a vertical upper header and a vertical lower header integral therewith, the upper header and the lower header having a lower-end opening and an upper-end opening respectively as arranged in a row, the connecting device comprising a blocklike connector body having two through bores corresponding to the respective openings and fixed to the heat exchanger with the through bores in coincidence with the respective openings, a tubular member being fluid-tightly fitted in each of the through bores, each said tubular member projecting beyond the blocklike connector body at solely one end, said one end being a connecting end projecting toward a connectable device, the connecting end being in the form of a spigot fittable in a socket of the connectable device.

2. A connecting device for a heat exchanger according to claim 1, the heat exchanger being a condenser having a supercooling unit which is provided by the portion of the heat exchanger below a horizontal plane through a boundary between the upper header and the lower header, the connectable device being a liquid receiver.

3. A connecting device for a heat exchanger having as arranged at one side thereof a vertical upper header and a vertical lower header integral therewith, the upper header and the lower header having a lower-end opening and an upper-end opening respectively as arranged in a row, the connecting device comprising a blocklike connector body having two through bores corresponding to the respective openings and fixed to the heat exchanger with the through bores in coincidence with the respective openings, a tubular member being fluid-tightly fitted in each of the through bores and having a connecting end projecting toward a connectable device, the connecting end being in the form of a spigot fittable in a socket of the connectable device;

wherein a member in the form of a short tube for positioning the connector body is fixedly fitted in each of the openings so as to project into the header by a short length and into the connector body by a long length, and the connector body has an inner peripheral surface defining each of the through bores and formed with an annular stepped portion for receiving the positioning member, the bore-defining peripheral surface being formed at one side thereof opposite to the positioning member with an annular stepped portion for receiving the portion of the tubular member fitted in.

4. A connecting device for a heat exchanger having as arranged at one side thereof a vertical upper header and a vertical lower header integral therewith, the upper header and the lower header having a lower-end opening and an upper-end opening respectively as arranged in a row, the connecting device comprising a blocklike connector body having two through bores corresponding to the respective openings and fixed to the heat exchanger with the through bores in coincidence with the respective openings, a tubular member being fluid-tightly fitted in each of the through bores and having a connecting end projecting toward a connectable device, the connecting end being in the form of a spigot fittable in a socket of the connectable device;

wherein the spigot of the tubular member and the portion thereof fitted in the through bore are each formed with an annular groove, and an O-ring is fitted in the annular groove, the fluid-tight fit of the tubular member in the through bore being realized by the O-ring.

5. A connecting device for a heat exchanger having as arranged at one side thereof a vertical upper header and a vertical lower header integral therewith, the upper header and the lower header having a lower-end opening and an upper-end opening respectively as arranged in a row, the connecting device comprising a blocklike connector body having two through bores corresponding to the respective openings and fixed to the heat exchanger with the through bores in coincidence with the respective openings, a tubular member being fluid-tightly fitted in each of the through bores and having a connecting end projecting toward a connectable device, the connecting end being in the form of a spigot fittable in a socket of the connectable device;

wherein the connector body is approximately square in vertical section, and the two through bores are each L-shaped.

* * * * *